428-408 SR
PFR27 XR 4,157,409

United States Patent [19]
Levitt et al.

[11] 4,157,409
[45] Jun. 5, 1979

[54] METHOD OF MAKING METAL IMPREGNATED GRAPHITE FIBERS

[75] Inventors: Albert P. Levitt, Newton Center; Hans E. Band, Bedford, both of Mass.

[73] Assignee: The United States of America as represented by the Secretary of the Army, Washington, D.C.

[21] Appl. No.: 937,387

[22] Filed: Aug. 28, 1978

[51] Int. Cl.[2] ..... C23C 1/00; B32B 15/14

[52] U.S. Cl. ..... 427/299; 427/404; 427/432; 427/433; 428/367; 428/389; 428/263; 428/272; 428/608

[58] Field of Search ..... 428/367, 389; 427/299, 427/404, 432, 113

[56] References Cited

U.S. PATENT DOCUMENTS 3,770,488 11/1973 Pepper et al. ..... 427/299

OTHER PUBLICATIONS

Goddard et al., AMMRC CTR 76-11, Preparation of Graphite-Aluminum Composites by the Sodium Process, Apr. 1976.

*Primary Examiner*—Ralph S. Kendall
*Attorney, Agent, or Firm*—Nathan Edelberg; Robert P. Gibson; Lawrence E. Labadini

[57] ABSTRACT

A method is disclosed for pretreating graphite fibers and woven graphite preforms so that they may be wetted and infiltrated by molten metals such as aluminum and alloys thereof. Pretreatment includes immersing graphite fibers or preforms in a bath of liquid NaK alloy at room temperature. The pretreatment allows a lower temperature and shorter immersion time than prior art processes and permits improved wetting and infiltration by the molten metal constituting the matrix of a graphite fiber reinforced metal composite.

14 Claims, No Drawings

METHOD OF MAKING METAL IMPREGNATED GRAPHITE FIBERS

The invention described herein may be manufactured, used, and licensed by or for the government for governmental purposes without the payment to us of any royalty thereon.

BACKGROUND OF THE INVENTION

This invention relates to the production of graphite fiber reinforced metals. A method is disclosed for the treatment of graphite fibers by molten sodium/potassium alloys (NaK) so that the fibers may be wetted and infiltrated by molten metals such as aluminum, magnesium, copper, tin, lead, zinc, and the like, as well as alloys thereof, thereby permitting the fabrication of improved graphite fiber reinforced metals at lower temperatures and shorter times than are currently required. The invention may be employed in the metal impregnation of woven graphite fiber preforms such as rings, cones, frusta and the like.

Graphite fibers exhibit extremely high tensile strengths and stiffness. Several types of graphite fiber are currently commercially available, being essentially partially graphitized carbon fibers, the degree of graphitization depending on the manufacturing method and the precursor material selected. Common precursors include polyacrylonitrile, pitch and rayon. The microcrystalline structures of the fibers show the basal planes of the graphite lattice lying parallel to the fiber axis. In rayon based fibers and polyacrylonitrile based fibers, the basal planes are circumferentially oriented, while in pitch precursor fibers the basal plane orientation is largely random with respect to the cross-section, but still parallel to the fiber axis. Composite materials containing graphite fibers in a matrix of another material such as a resin or a metal combine the physical properties of the graphite fiber, high tensile strength, stiffness and elevated temperature resistance, with the properties of the matrix material. Graphite metal composites not only exhibit the combined structural properties of graphite and the metal, but in addition are extremely light weight in relation to their strength, due to the relatively low density of graphite.

Graphite fiber reinforced metals are fabricated by immersing the fiber in a bath of the molten metal. A principal difficulty in the manufacture of graphite fiber reinforced metals arises from the fact that such metals as aluminum, magnesium, copper, tin, lead, zinc and various alloys thereof do not readily wet graphite fibers, making it difficult to impregnate the fibers with the molten metal. To overcome this problem, various pretreatments have been employed in the prior art. One pretreatment commonly used in the prior art involves deposition from the vapor phase of titanium and boron in combination. Another technique, more pertinent to the present invention, is disclosed in U.S. Pat. No. 3,770,488 to Pepper, et al., wherein the graphite fiber is first infiltrated with molten sodium before immersion in the molten bath of matrix metal. The graphite fiber must be immersed in a molten bath of liquid sodium maintained at 550° C. under an atmosphere of argon for about 15 minutes. In a second step of the process, the fibers are removed from the molten sodium and transferred to, and immersed in, a molten bath of the desired metal matrix. After an appropriate immersion time, the composite fibers are removed from the alloy bath, and cooled to form graphite metal composite fibers. Regardless of which prior art method is used for pretreating the graphite fibers to make them wettable, the fabrication of more complex articles requires a third step, in which graphite metal composite fibers are woven into the final desired shape, which may then be clad with alloy, as by hot pressing.

SUMMARY OF THE INVENTION

The present invention provides a method for pretreating graphite fibers and woven graphite preforms so that they may be wetted and infiltrated by molten metals such as aluminum, magnesium, copper, tin, lead, zinc, and alloys thereof. Improved graphite fiber reinforced metals are thereby produced. The method employs lower temperatures and shorter times than are currently required and permit the direct metal impregnation of woven graphite preforms, thereby eliminating a step formerly required in the fabrication of graphite fiber reinforced articles.

For this invention, any of the various types of graphite fiber are sequentially dipped, while covered by an inert atmosphere, into a bath of liquid NaK alloy, a molten bath of tin containing 1–2% magnesium, and a molten aluminum alloy or other molten metal, as mentioned above. The highly reactive liquid NaK deposits a very thin film of NaK on the fibers. When the coated fibers are then immersed into the tin/magnesium bath, most of the NaK is displaced, and what remains forms a tin/magnesium/sodium/potassium alloy which, when the fibers are dipped into molten aluminum alloy or other metal, forms on cooling a graphite fiber reinforced aluminum or other metal, wire, or other structure, depending on the configuration of the graphite fibers originally used. Where the metal matrix alloy is of suitable composition, the intermediate immersion in molten tin/magnesium alloy may be omitted.

The process is advantageous for the following reasons: NaK alloy is liquid at room temperature. The pretreatment step may therefore be carried out more simply and more economically than prior art processes requiring high temperature or high vacuum conditions. The possibility of thermal degradation or chemical attack is reduced. Further, NaK interacts with graphite more readily than liquid sodium. A more effective wetting, with fewer side reactions, is thereby obtained. Because of the more effective wetting, woven graphite fiber preforms can be as effectively impregnated as single fibers, thereby simplifying the fabrication of graphite reinforced articles.

DETAILED DESCRIPTION OF THE INVENTION

For the purpose of describing the present invention, the term graphite fibers is used to describe any of the partially graphitized carbon fibers known in the art, as described herein. The fibers may be woven into preformed articles such as sheets, rings, cones, frusta and the like, prior to treatment.

In pure form, metallic sodium and potassium are both solid at room temperature. However, an alloy of the two is liquid at room temperature from 57% by weight sodium and 43% by weight potassium to 13% by weight sodium and 87% by weight potassium. The use of a room temperature immersion bath reduces the energy requirement, simplifies the process, reduces the attack of the alkali metals on the graphite, and reduces the level of hazard. In addition, potassium interacts with graphite at room temperature in a manner which is not as yet thoroughly understood. Because of such interaction, the inclusion of potassium in the pretreatment immersion has been observed to improve the degree of wetting and infiltration of the graphite fibers and to provide this advantage in a time period shortened by almost two orders of magnitude compared to a molten sodium process. Furthermore, the ability to employ potassium at room temperature avoids any destructive reactions which occur between graphite and potassium at elevated temperatures and which preclude the use of pure molten potassium as a pretreating agent.

A preferred composition for the sodium/potassium alloy is 44%±1% sodium and 56%±1% of potassium by weight. Using the preferred NaK composition, immersion at room temperature may be for as little as 10 seconds. Longer immersion, up to several minutes, while unnecessary, may be employed without damage to the fibers. Shorter immersion times may also be employed, although it will be apparent to those skilled in the art that a minimum immersion time will be found for which the wetting effect is insufficient. The preferred working temperature is room temperature, for convenience. However, lower temperatures could be used, depending upon the composition of the NaK alloy, as long as the alloy is liquid at the desired temperature. For example, using the preferred composition NaK alloy, the minimum working temperature is 5° C. Higher temperatures may be employed, with concomitantly shorter immersion times. Such conditions might be desirable, for example, in a rapid continuous passage process. However, temperatures greater than 200° C. are to be avoided in order to prevent undesirable side reactions.

Dipping and immersion in liquid NaK must be carried out in an inert atmosphere free of water vapor and oxygen. A controlled atmosphere glove box may be used, provided with an argon atmosphere, with provision for gas purification and recirculation. Preferably, the oxygen level should be maintained at less than 10 parts per million.

Following immersion in NaK, the fibers may be dipped in an intermediate bath of molten tin or tin containing 1-2% magnesium. The tin bath is maintained at a temperature of 238° C. to maintain the tin in a molten state. In the final step, the fibers are immersed in molten aluminum, aluminum alloy or other desired matrix metal at a temperature sufficient to maintain the metal in a molten state. The intermediate immersion in the tin/-magnesium bath serves to provide an optimum intermediate alloy composition suitable for bonding the matrix metal to the graphite fibers. The intermediate immersion step may be omitted, optionally, especially in the situation where the final matrix metal alloy contains elements such as silicon, titanium or boron capable of forming carbides.

Graphite fiber reinforced articles may be made from the resulting composite wire woven or layed up and consolidated by hot pressing between aluminum or alloy layers of appropriate shape. Finished structures made in this fashion have been cut in transverse section and examined microscopically. The fibers have been found to be fully infiltrated by and well-bonded to the aluminum matrix with no indication of interfacial reaction between fiber and matrix. As an alternate method, the pretreated graphite yarns may be layed up in a mold and the composite directly cast into final form by filling the mold with molten aluminum.

In addition, the process of the present invention permits the fabrication of finished graphite fiber reinforced metal structures such as woven graphite fiber preforms in the shape of rings, cones, frusta, strips and the like by sequentially dipping the woven graphite fiber preforms into the molten metal baths as described above. For example, a graphite fiber reinforced aluminum ring can be made in this way. The foregoing procedure is made possible by the present NaK pretreatment process which provides sufficient infiltration of the woven graphite fiber preforms by the NaK immersion to permit adequate penetration of the aluminum or alloy used in the final immersion step. The process step involved in consolidating graphite/aluminum or graphite/metal wires in the finished structures is therefore eliminated.

EXAMPLE 1

Graphite fibers of the pitch type, Thornel, Trademark Union Carbide Corporation, New York, New York, were reinforced with 6061 Aluminum. All immersion steps were carried out in an argon atmosphere in a gastight, temperature resistant glove box. The fibers were first dipped into liquid NaK alloy, 44%±1% Na and 56%±1% K by weight, for 10 seconds at room temperature, then transferred by dipping into a molten tin bath containing 1%-2% magnesium at 238° C. for 5 minutes, then transferred by dipping into molten 6061 Aluminum at 666° C. for 5 minutes. The resulting composite wires were then consolidated between two ⅛" layers of 6061 Aluminum at 228 lbs/in$^2$ at a temperature of 640° C.-582° C. for 35 minutes. Cross-sections of the completed composite were examined in the optical microscope at 500-fold magnification. The fibers were fully infiltrated by and well-bonded to the 6061 Aluminum matrix with no indication of interfacial reaction between fiber and matrix.

EXAMPLE 2

The following fiber/metal matrix combinations were made:

(1) Union Carbide Type "P", Pitch type fibers, Union Carbide Corp., New York, N.Y., and 6061 Aluminum.

(2) Morganite Modmor I, Trademark, Morganite Modmor Inc., Costa Mesa, Calif., polyacrylonitrile type fibers and 6061 Aluminum.

(3) Celanese Celion GY-70, Trademark, Celanese Corp., Summit, N.J., polyacrylonitrile type fibers and 6061 Aluminum.

(4) Union Carbide Thornel 75, Trademark, Union Carbide Corp., New York, N.Y., Rayon type fibers and 6061 Aluminum.

(5) Union Carbide Thornel 50, Trademark, Union Carbide Corp., New York, N.Y., Rayon type fibers and 6061 Aluminum.

(6) Hercules Magnamite HMPVA, Trademark, Hercules Inc., Magna, Utah, polyacrylonitrile type fibers and 6061 Aluminum.

All of the foregoing fiber tows were treated with NaK at room temperature for 10 seconds, then with the Tin-2% Mg bath at temperatures between 200 and 400° C., then with molten 6061 Aluminum at about 680° C. The procedure was carried out in a glove box under an argon atmosphere with less than 20 ppm oxygen content. The oxygen concentration was monitored continuously with a Trace Oxygen Analyzer connected to the glove box. The molten metal baths were skimmed before immersing the samples. After allowing the coated specimens to cool they were cleaned and subsequently hot-pressed in 6061 Aluminum at 640°–582° C. and 228 psi for 30–40 minutes. Upon mounting the samples for micrographic analysis, all exhibited various degress of infiltration by the final aluminum matrix, with no discernible interfacial layers at 500× optical magnification.

EXAMPLE 3

A graphite fiber reinforced aluminum ring is fabricated. A preformed ring of woven graphite fibers is sequentially dipped into NaK, tin/magnesium and 6061 Aluminum, as described in Example 1. Upon cooling, a graphite fiber reinforced composite article results, without resorting to an additional step of consolidating graphite aluminum wires into the finished structure.

While the invention has been described in connection with specific embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the essential features hereinbefore set forth, and as follows in the scope of the appended claims.

What is claimed is:

1. A process for fabricating graphite fiber reinforced metal comprising in sequence the steps of:

immersing a graphite fiber in a bath of liquid NaK alloy in an inert atmosphere for a period of time sufficient to enhance the wettability and infiltration of the graphite fiber, wherein the composition of the NaK alloy is such that the alloy is a liquid at room temperature, transferring the fiber to, and immersing the fiber in, a molten bath of metal selected from the group consisting of aluminum, magnesium, copper, tin, lead, zinc and alloys thereof whereby the metal wets, infiltrates and coats the graphite fiber, and removing the metal-coated fiber from the molten metal bath whereby upon cooling the metal hardens and a graphite fiber reinforced metal is fabricated.

2. A process according to claim 1 wherein, following the NaK immersion step and preceding the metal immersion step, the fiber is treated by immersing the fiber in a molten bath of tin or an alloy of the containing 1%–2% magnesium.

3. A process according to claim 1 wherein the NaK alloy consists of from 13% to 57% by weight of Na and from 43% to 87% by weight of K.

4. A process according to claim 3 wherein the composition of the NaK alloy is 44%±1% Na and 56%±1% K by weight and wherein the temperature of the NaK alloy bath is from 5° C. to 200° C.

5. A process according to claim 3 wherein the NaK alloy bath is maintained at room temperature.

6. A process according to claim 5 wherein the time of immersion in the NaK bath is about 10 seconds.

7. A process according to claim 6 wherein the time of immersion in the molten metal bath is about 5 minutes.

8. A method of making a graphite fiber reinforced metal article comprising in sequence the steps of:

fabricating a graphite fiber preform of the article, immersing the preform in a bath of liquid NaK alloy in an inert atmosphere for a period of time sufficient to enhance the wettability and infiltration of the graphite fiber preform, wherein the composition of the NaK alloy is such that the alloy is a liquid at room temperature transferring the preform to and immersing the preform in, a molten bath of metal selected from the group consisting of aluminum, magnesium, copper, tin, lead, zinc and alloys thereof, whereby the metal wets, infiltrates and coats the preform, and removing the metal-coated preform from the molten metal bath whereby upon cooling the metal hardens and a graphite fiber reinforced metal article is made.

9. A method according to claim 8 wherein, following the NaK immersion step and preceding the metal immersion step, the article is treated by immersing the article in a molten bath of tin or an alloy of tin containing 1%–2% magnesium.

10. A process according to claim 8 wherein the NaK alloy consists of from 13% to 57% by weight of Na and from 43% to 87% by weight of K.

11. A method according to claim 10 wherein the composition of the NaK alloy is 44%±1% Na and 56%±1% K. by weight and wherein the temperature of the NaK alloy bath is from 5° C. to 200° C.

12. A method according to claim 10 wherein the NaK alloy is maintained at room temperature.

13. A method according to claim 12 wherein the time of immersion in the NaK bath is about 10 seconds.

14. A method according to claim 13 wherein the time of immersion in the molten metal bath is about 5 minutes.

* * * * *